US006209241B1

(12) United States Patent
Louw

(10) Patent No.: US 6,209,241 B1
(45) Date of Patent: Apr. 3, 2001

(54) GARMENT HANGER

(76) Inventor: Henry J. Louw, P.O. Box 125, Plumstead 7800, Cape Town (ZA)

( * ) Notice: Subject to any disclaimer, the term of this patent is extended or adjusted under 35 U.S.C. 154(b) by 0 days.

(21) Appl. No.: 09/041,165

(22) Filed: Mar. 12, 1998

(51) Int. Cl.[7] ..... G09F 03/08
(52) U.S. Cl. ..... 40/322; 223/85
(58) Field of Search ..... 40/322; 223/85

(56) References Cited

U.S. PATENT DOCUMENTS

| | | | |
|---|---|---|---|
| D. 192,845 | | 5/1962 | Cohen . |
| D. 244,197 | | 5/1977 | Ostroll . |
| 333,303 | | 12/1885 | Howard . |
| 900,969 | | 10/1908 | Wallace . |
| 901,901 | | 10/1908 | Hornich, Jr. . |
| 1,142,720 | | 6/1915 | McAuley . |
| 1,510,915 | | 10/1924 | Bartholdi . |
| 1,634,377 | | 7/1927 | Montan et al. . |
| 2,014,061 | | 9/1935 | Anderson . |
| 2,074,841 | | 3/1937 | Haimowitz . |
| 2,099,596 | | 11/1937 | Bruening . |
| 2,178,055 | | 10/1939 | Stupell . |
| 2,288,071 | | 6/1942 | Cohen . |
| 2,543,350 | | 2/1951 | Bross . |
| 2,658,627 | | 11/1953 | Magnuson . |
| 2,710,489 | | 6/1955 | Myers, Jr. . |
| 2,864,147 | | 12/1958 | Solow . |
| 3,024,953 | | 3/1962 | O'Keefe . |
| 3,112,050 | | 11/1963 | Eason . |
| 3,535,808 | | 10/1970 | Morrish . |
| 3,685,189 | | 8/1972 | Conger . |
| 3,731,857 | | 5/1973 | Haggar . |
| 3,879,870 | | 4/1975 | Bachand . |
| 3,949,914 | | 4/1976 | Ostroll . |
| 3,965,602 | | 6/1976 | Whitney . |
| 4,045,899 | | 9/1977 | Richardson . |
| 4,115,940 | | 9/1978 | Phillips . |
| 4,137,661 | | 2/1979 | Johansson . |
| 4,155,493 | | 5/1979 | Palmaer . |
| 4,160,333 | | 7/1979 | Indelicato . |
| 4,198,773 | | 4/1980 | Batts et al. . |
| 4,322,902 | | 4/1982 | Lenthall . |
| 4,997,114 | * | 3/1991 | Petrou ..... 223/85 |
| 5,096,101 | * | 3/1992 | Norman et al. ..... 223/85 |
| 5,305,933 | * | 4/1994 | Zuckerman ..... 40/322 X |
| 5,503,310 | * | 4/1996 | Zuckerman et al. ..... 40/322 X |
| 5,603,437 | * | 2/1997 | Zuckerman ..... 223/85 |

FOREIGN PATENT DOCUMENTS

| | | |
|---|---|---|
| 140722 | 4/1951 | (AU) . |
| 141875 | 6/1951 | (AU) . |
| 163486 | 6/1955 | (AU) . |
| 255815 | 3/1961 | (AU) . |
| 287964 | 6/1965 | (AU) . |
| 6053769 | 9/1969 | (AU) . |
| 6087369 | 3/1971 | (AU) . |
| 459115 | 9/1972 | (AU) . |
| 70092 | 7/1982 | (AU) . |
| 1095207 | 3/1955 | (FR) . |
| 2765 | 9/1893 | (GB) . |
| 660527 | 11/1951 | (GB) . |
| 1151407 | 2/1968 | (GB) . |
| 1127937 | 9/1968 | (GB) . |
| 1299986 | 12/1972 | (GB) . |
| 1397413 | 6/1975 | (GB) . |
| 1439985 | 6/1976 | (GB) . |
| 1510479 | 5/1978 | (GB) . |
| 1540371 | 2/1979 | (GB) . |
| 109314 | 8/1966 | (NO) . |

* cited by examiner

*Primary Examiner*—Joanne Silbermann
(74) *Attorney, Agent, or Firm*—Ostrolenk, Faber, Gerb & Soffen, LLP

(57) ABSTRACT

A hanger includes a suspension hook adapted to engage a hook support and having an upper portion including at least a partial recess; and an indicator having front, rear, side, top and bottom portions, the front portion including a surface for displacing indicia, the partial recess being adapted to releasably receive at least a portion of the side or bottom portions of the indicator such that the indicator is releasably coupled to the suspension hook.

21 Claims, 7 Drawing Sheets

FIG. 5B
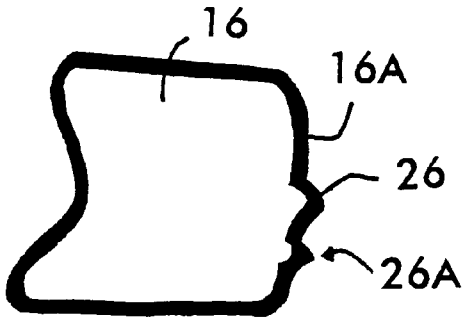
FIG. 5A
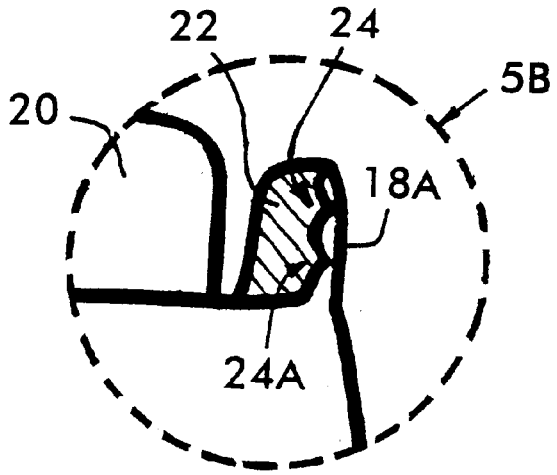
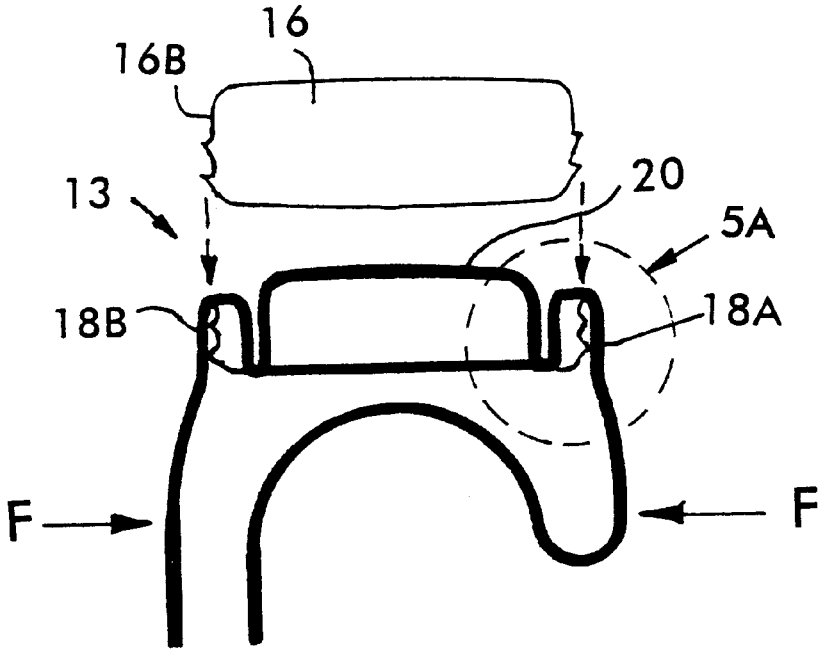
FIG. 5

GARMENT HANGER

BACKGROUND OF THE INVENTION

1. Field of the Invention

The present invention relates to improvements in indicators (or size caps) for garment hangers and, more particularly, to indicators which are removably coupled to a top portion of the garment hangers.

2. Description of Related Art

Various types of garment hangers employing size caps are known. For example, U.S. Pat. No. 4,322,902 and its Re-examination Certificate disclose an indicator for a garment hanger having a body portion containing indicia where the body portion includes a means for releasably attaching the indicator to a part of the hanger.

The '902 patent also discloses an attaching means having a head shank having two separated portions which are resiliently deformable towards a central cavity to enable the head shank to be inserted into and removed from a slot or other opening formed in a display portion of a hanger.

The '902 patent further discloses an indicating device having a shaped body including a wide base, a narrower top and a cavity having an entrance opening within the wide base for receiving a supporting means. The supporting means includes an enlarged head which is larger in size than an opening in the top of the indicator to enable the indicator to be engaged with the enlarged head.

Unfortunately, the prior art size caps and hangers, such as the hanger of the '902 patent, are substantially complex and difficult and costly to manufacture, such as by injection molding or the like. Consequently, there is a need in the art for a size cap which is releasably coupled to a garment hanger, simple to use and inexpensive to manufacture.

SUMMARY OF THE INVENTION

In order to overcome the disadvantages of the prior art, a garment hanger in accordance with the present invention includes a suspension hook adapted to engage a hook support and having an upper portion including at least a partial recess; and an indicator having front, rear, side, top and bottom portions, the front portion including a surface for displacing indicia, the partial recess being adapted to releasably receive at least a portion of the side or bottom portions of the indicator such that the indicator is releasably coupled to the suspension hook.

Other features and advantages of the present invention will become apparent from the following description of the invention which refers to the accompanying drawings.

BRIEF DESCRIPTION OF THE DRAWINGS

The invention will now be described by way of example with reference to the accompanying drawings.

FIG. 5 shows front and magnified views of a garment hanger in accordance with another embodiment of the present invention;

FIG. 5A is a magnified view of the garment hanger shown in FIG. 5;

FIG. 5B is a magnified view of the garment hanger shown in FIG. 5A;

DETAILED DESCRIPTION OF THE PREFERRED EMBODIMENTS OF THE INVENTION

Figure 1:
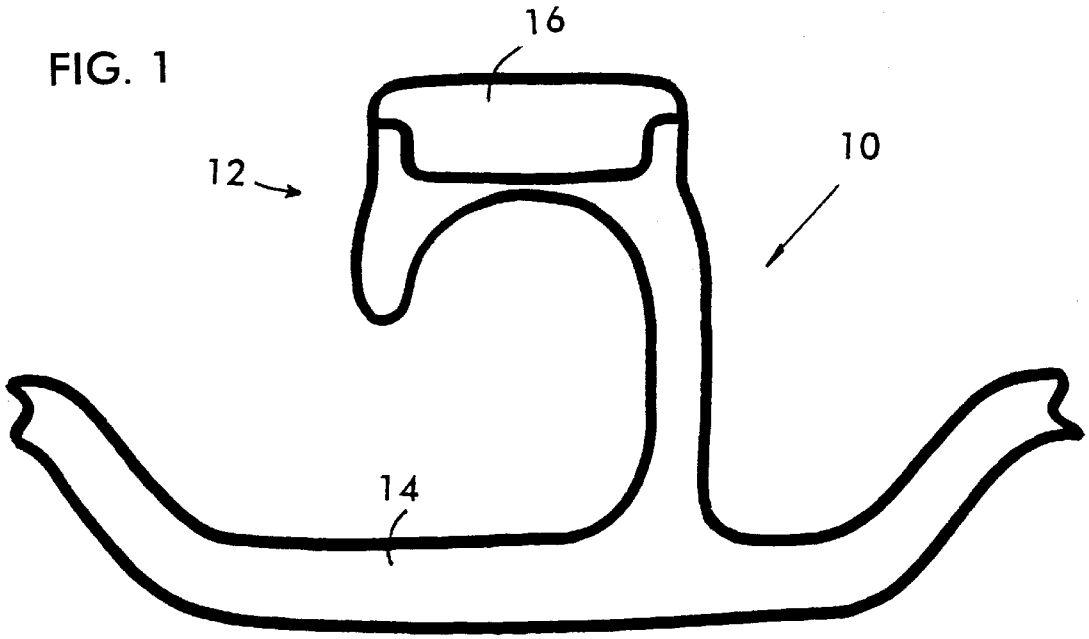
FIG. 1 is a front view of a garment hanger in accordance with the present invention.

Referring to the drawings wherein like numerals indicate like elements there is shown in FIG. 1 a garment hanger 10 which may be formed from any of the known materials by any of the known techniques. Preferably, garment hanger 10 is made from plastic using an injection molding technique.

Garment hanger 10 includes a suspension hook 12 attached at its lower end to an elongated bar 14. Bar 14 usually includes a garment support means at either end thereof (not shown).

Garment hanger 10 also includes an indicator (or size cap) 16 which is adapted to display any desirable indicia, such as the size of the garment being hung from the hanger 10 and/or the name of the manufacturer.

Figure 2:
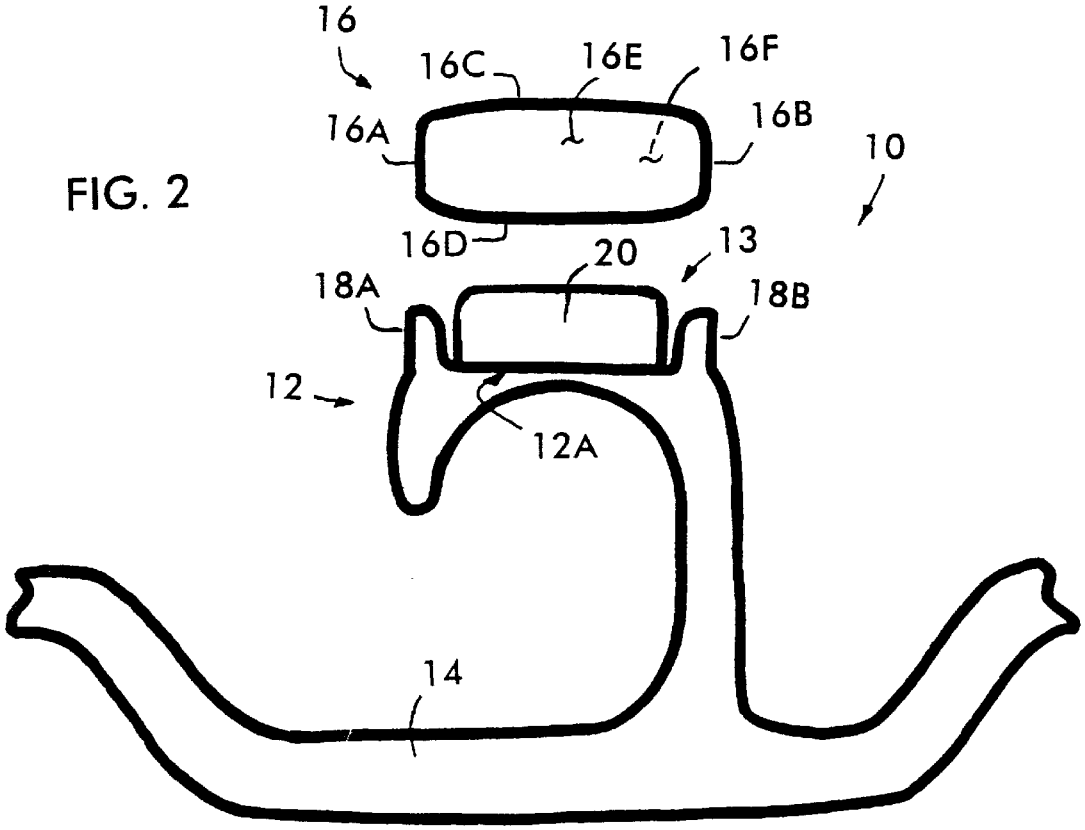
FIG. 2 is a front view of the garment hanger of FIG. 1 with the size cap removed from the hanger.

Referring to FIG. 2, size cap 16 includes side edges 16A, 16B, top and bottom edges 16C, 16D and front and rear surfaces 16E, 16F for displaying indicia. Preferably, size cap 16 is in the form of a substantially rectangular and flat plate having a height of about ½ inch from top edge 16C to bottom edge 16D and a width of about 1½ inches from side edge 16A to side edge 16B. It is also preferable that the size cap 16 have a thickness of about 1/16 of an inch.

Garment hanger 10 is shown in FIG. 2 with size cap 16 removed from the suspension hook 12. On top of suspension hook 12 there is an attachment portion 13 to attach size cap 16 to garment hanger 10. Attachment portion 13 includes tab portions 18A, 18B that extend upwardly from opposite ends of a preferably substantially planar upper portion 12A of suspension hook 12. Attachment portion 13 further includes a support means 20 that also extends upwardly from the upper portion 12A of the suspension hook 12. Preferably, support means 20 is a substantially flat, planar plate which is substantially centrally located between tab portions 18A, 18B. Preferably, attachment portion 13 includes a mechanism which permits size cap 16 to be securely and detachably coupled to suspension hook 12.

Figure 3B:
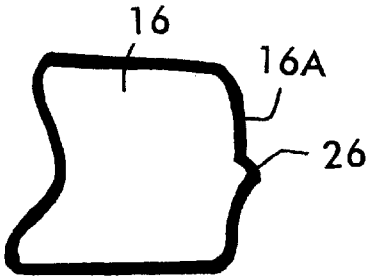
FIG. 3B is a magnified view of the garment hanger shown in FIG. 3A.
Figure 3A:
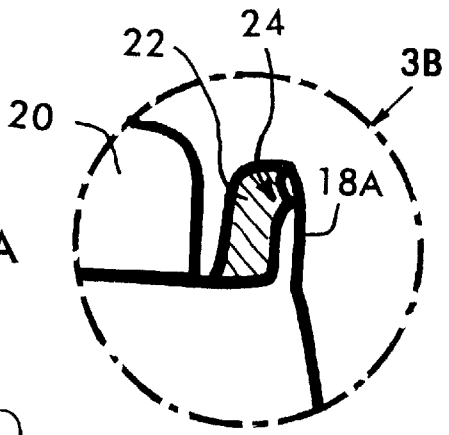
FIG. 3A is a magnified view of the garment hanger shown in FIG. 3.
Figure 3:
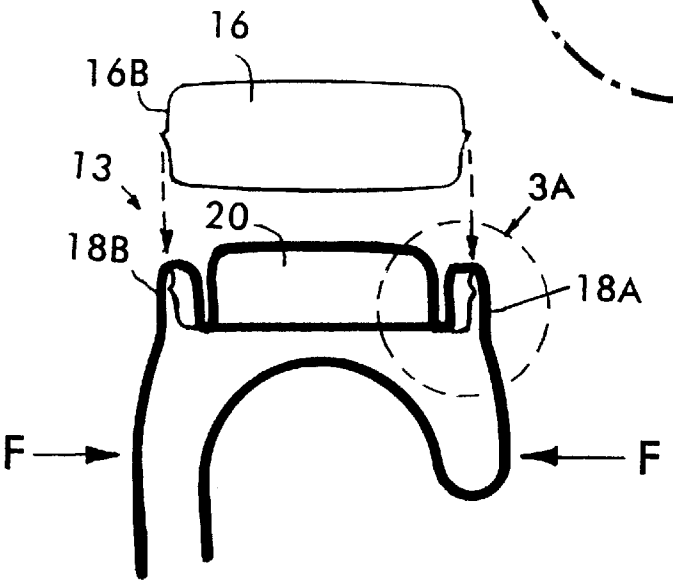
FIG. 3 shows rear and magnified views of the garment hanger of FIG. 2 which include additional details of the detachment feature of the present invention.

Referring now to FIG. 3, tab portions 18A, 18B include a cutaway 22 forming a notch 24. Size cap 16 includes a protrusion 26 on each side edge 16A, 16B. Protrusions 26 are receivable within notches 24 such that protrusions 26 are snap-fittable into notches 24 and retain size cap 16 onto suspension hook 12. Support means 20 is adapted to rest against at least one of the front or rear surfaces of size cap 16 such that side edges 16A, 16B of the size cap 16 cannot slip axially out of cutaways 22 of the tab portions 18A, 18B.

Figure 4A:
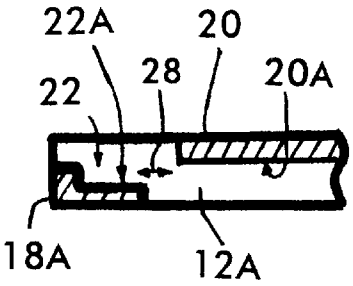
FIG. 4A is a magnified view of the garment hanger shown in FIG. 4.
Figure 4:
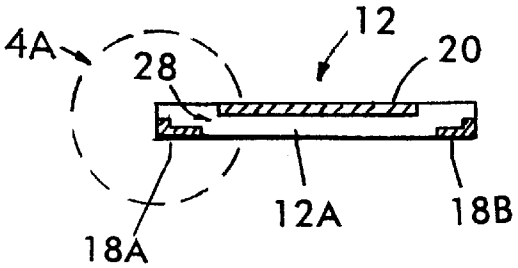
FIG. 4 is a top view of the garment hanger of FIGS. 1–3.

With reference to FIG. 4, the upper portion 12A of the suspension hook 12 includes a base that is preferably circumscribed by the opposing lateral edges and opposing axial edges shown. It is preferred that support means 20 include a front surface 20A which contacts one of the front and/or rear surfaces of size cap 16 when size cap 16 is attached to suspension hook 12. It is most preferred that each of tab portions 18A, 18B include a surface 22A in the area of the cutaway 22 which engages the other of the front and/or rear surfaces of size cap 16. Thus, surfaces 22A of tab portions 18A, 18B are spaced away from and define a plane which faces front surface 20A of support means 20. As will be apparent to those skilled in the art from the above teaching, surface 22A may be laterally (left to right in FIG. 4) and axially displaced from front surface 20A of support means 20 while still preventing the size cap 16 from slipping axially out of the cutaways 22.

It is noted that surfaces 22A of tab portions 18A, 18B and front surface 20A of support means 20 form a cavity (or recess) 28 in which at least a portion of size cap 16 is received. With reference to FIG. 3, when size cap 16 is inserted into cavity 28, tab portions 18A, 18B resiliently move outwardly from side edges 16A, 16B as protrusions 26 approach notches 24.

Subsequently, protrusions 26 snap into notches 24 and tab portions 18A, 18B move inwardly to engage side edges 16A, 16B.

Size cap 16 may be easily released from suspension hook 12 by applying opposing forces F in the directions of the arrows (FIG. 3). Forces F cause tab portions 18A, 18B to move outwardly away from side edges 16A, 16B, respectively, thereby disengaging protrusions 26 from notches 24 and releasing size cap 16.

Referring to FIGS. 3 and 4, size cap 16 may have one form of indicia (for example, a first garment size) on front surface 16E and a different form of indicia (for example, a second garment size) on rear surface 16F. When size cap 16 is coupled to suspension hook 12 such that rear surface 16F is engaged with surface 20A of support means 20, the indicia on front surface 16E of size cap 16 is visible but the indicia on rear surface 16F of size cap 16 may be hidden. Conversely, when size cap is coupled to suspension hook 12 such that front surface 16E is engaged with surface 20A of support means 20, the indicia on rear surface 16F of size cap 16 is visible but the indicia on front surface 16E of size cap 16 may be hidden.

Thus, one size cap 16 may be used to display different indicia (for example, different sized garments) by reversing the orientation of the surfaces 16E, 16F with respect to the suspension hook 20. One skilled in the art from the above teaching will recognize that the size and shape of the support means 20 is selected to cover at least a portion of the indicia on the front and/or rear surfaces 16E, 16F to enable size cap 16 to be used for displaying different indicia.

Referring now to FIG. 5, an alternative embodiment of the invention is shown which more securely couples size cap 16 to suspension hook 12. In particular, size cap 16 may include at least two protrusions 26, 26A on each side edge 16A, 16B and each tab portion 18A, 18B may include at least two corresponding notches 24, 24A. The protrusions 26, 26A are receivable within notches 24, 24A, respectively, such that protrusions 26, 26A are snap-fittable into notches 24, 24A and retain size cap 16 onto suspension hook 12.

The use of at least two protrusions 26, 26A and at least two notches 24, 24A mitigates against the inadvertent separation of size cap 16 from suspension hook 12 which could result in loss of size cap 16 and/or present a safety hazard to children.

It is noted that size cap 16 can alternatively be coupled to suspension hook 12 without cutaway 22 or notch 24. With such an alternative structure, the attachment portion 13 is constructed and arranged such that the size cap 16 fits between support means 20 and tab portions 18A, 18B (not shown) and is secured therebetween by a friction-fit.

Figure 7:
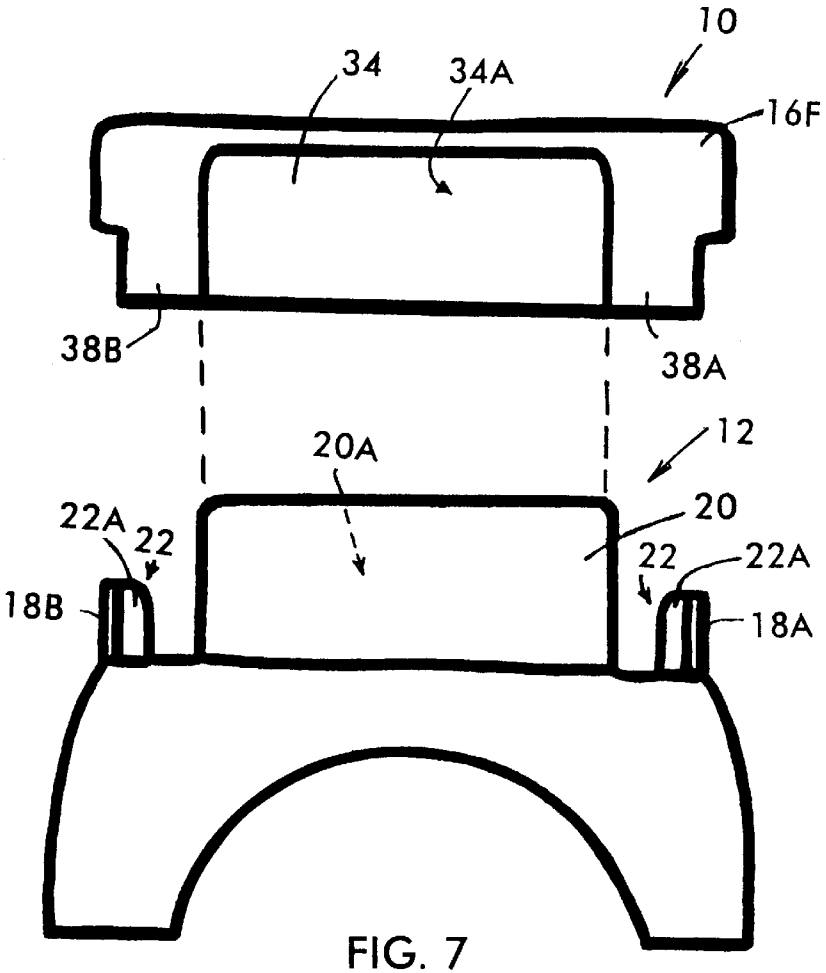
FIG. 7 is a rear view of the garment hanger of FIG. 6.
Figure 6:
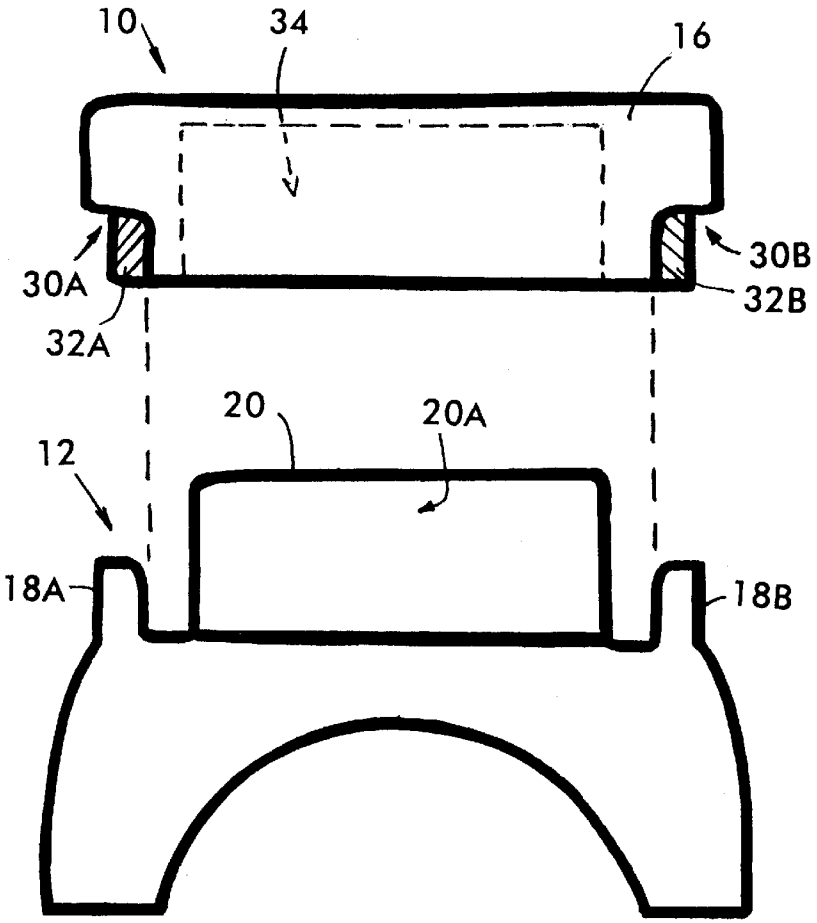
FIG. 6 is a front view of a garment hanger in accordance with another embodiment of the present invention.

Reference is now made to FIGS. 6 and 7 which show a suspension hook 12 of a garment hanger 10 in accordance with an alternative embodiment of the present invention. FIG. 6 shows a front view of suspension hook 12 while FIG. 7 shows a rear view thereof. The primary difference between suspension hook 12 of FIG. 6 and the suspension hook 12 of FIG. 1 is that support means 20 is positioned axially forward (i.e., in an axis coming out of the page) such that front surface 20A of support means 20 is substantially co-planar with surfaces 22A of tab portions 18A, 18B (FIG. 8).

Size cap 16 includes a recess 34 for receiving at least a portion of support means 20 (FIG. 7). More particularly, recess 34 includes an inside surface 34A which contacts front face 20A of support means 20. Size cap 16 also includes cutaways 30A, 30B on respective side edges 16A, 16B for receiving at least part of tab portions 18A, 18B, respectively (best seen in FIG. 6). Cutaways 30A, 30B form surfaces 32A, 32B, respectively in size cap 16 for contacting surfaces 22A of tab portions 18A, 18B.

Figure 8A:
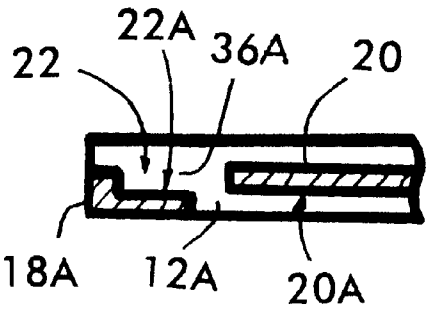
FIG. 8A is a magnified view of the garment hanger shown in FIG. 8.
Figure 8:
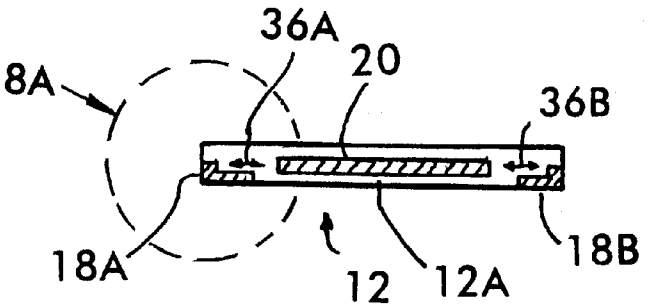
FIG. 8 is a top view of the garment hanger shown in FIGS. 6–7.

Reference is now made to FIGS. 7 and 8. Unlike suspension hook 12 of FIG. 4, support means 20 of suspension hook 12 of FIG. 8 is moved axially forward towards tab portions 18A, 18B such that relatively short channels 36A, 36B are formed between cutaways 22 of tabs 18A, 18B and support means 20. Cutaways 30A, 30B (FIG. 6) and recess 34 form tab portions 38A, 38B, respectively on size cap 16 (FIG. 7). Tab portions 38A, 38B are received in channels 36A, 36B, respectively, to firmly receive and couple size cap 16 to suspension hook 12, preferably by a friction-fit. As shown in FIG. 8, the upper portion 12A of the suspension hook 12 includes a base that is preferably circumscribed by the opposing lateral edges and the opposing axial edges.

Figure 9:
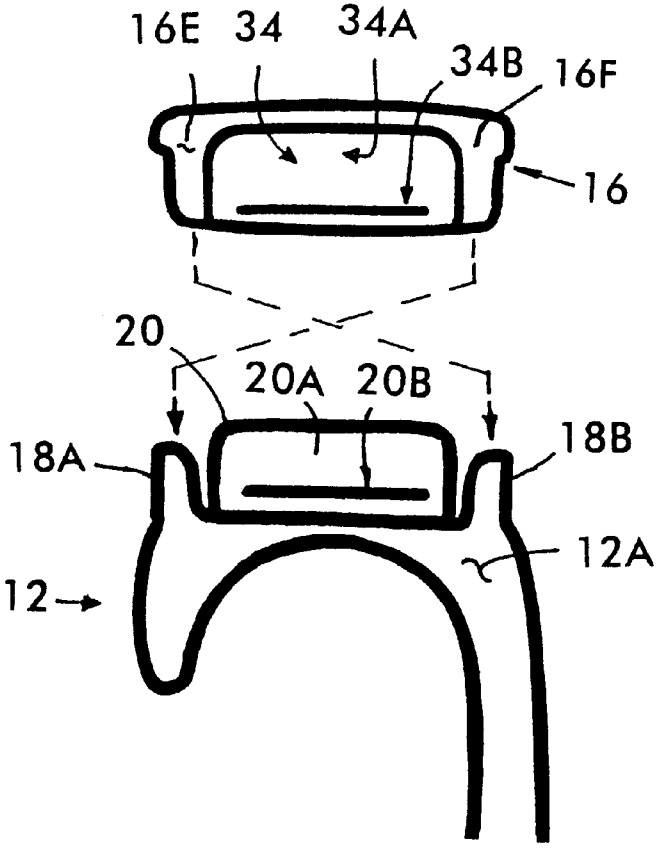
FIG. 9 is a front view of another embodiment of a garment hanger in accordance with the present invention.

With reference to FIG. 9, front surface 20A of support means 20 preferably includes a protrusion 20B, preferably a longitudinal protrusion (or ridge) and a notch 34B disposed on inner surface 34A of recess 34 to more firmly couple size cap 16 to suspension hook 12. Preferably, notch 34B is a longitudinal notch (or relatively shallow channel) for receiving protrusion 20B therein. Thus, when size cap 16 is coupled to suspension hook 12, protrusion 20B operatively engages notch 34B so that size cap 16 is securely engaged with suspension hook 12.

It should be apparent to one skilled in the art in light of the above teaching that the front surface 16E of size cap 16 of FIG. 9 may be flush with a front surface 12A of suspension hook 12 because cutaways 30A, 30B (FIG. 6) may be adapted to receive tab portions 18A, 18B therein, thereby permitting size cap 16 to move axially forward and attain a flush position with suspension hook 12. Likewise, when viewed from the rear (FIG. 7) recess 34 may be adapted to receive support means 20 therein such that support means 20 and tab members 38A, 38B are substantially flush, thereby giving the hanger 10 a more uniform appearance when size cap 16 is coupled to suspension hook 12.

Figure 10:
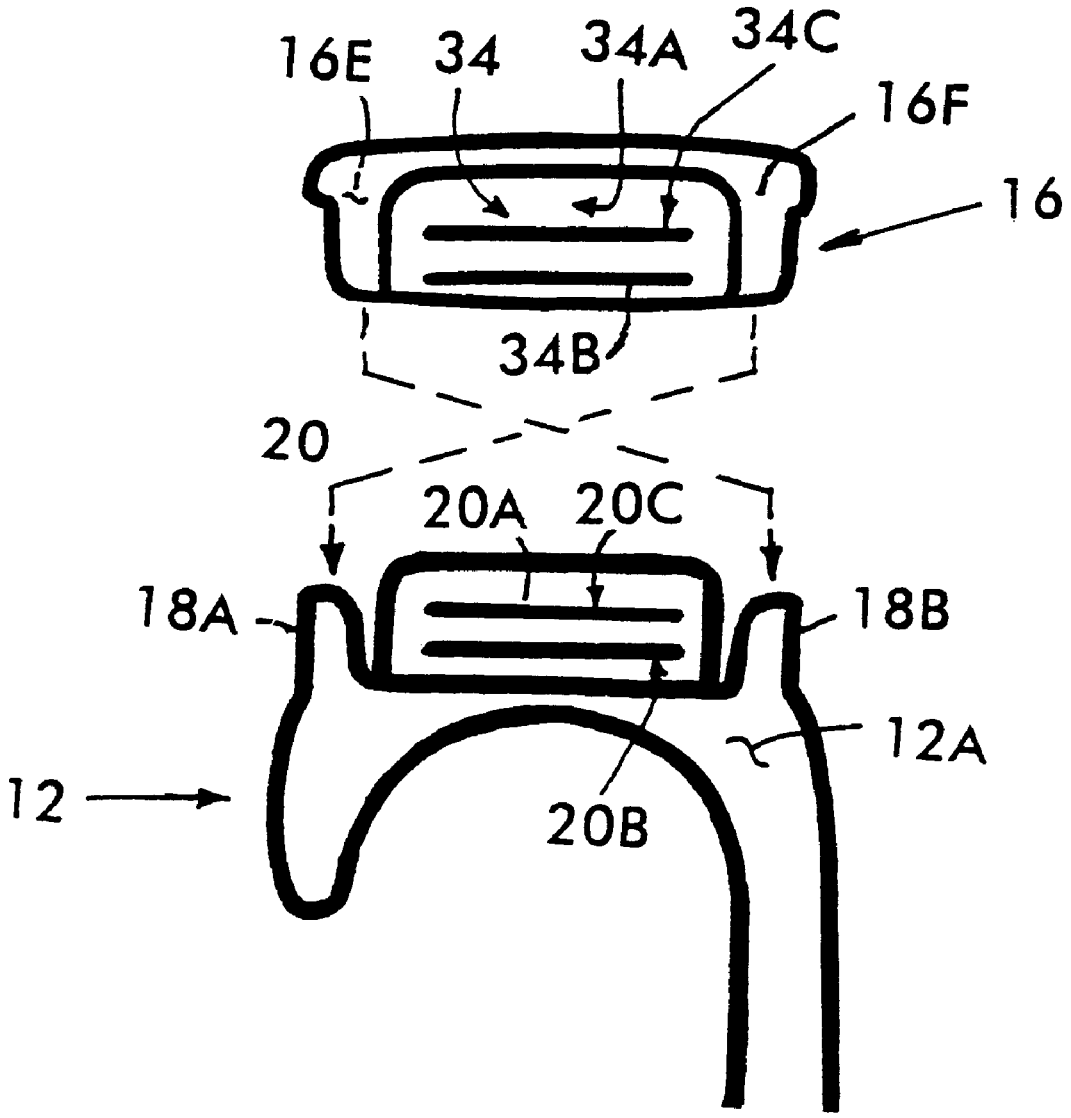
FIG. 10 is a front view of another embodiment of a garment hanger in accordance with the present invention.

Referring now to FIG. 10, an alternative embodiment of the invention is shown which more securely couples size cap 16 to suspension hook 12. In particular, front surface 20A of support means 20 may include at least two protrusions 20B, 20C, preferably longitudinal protrusions (or ridges). Inner surface 34A of recess 34 may include at least two corresponding notches 34B, 34C, preferably longitudinal notches (or relatively shallow channels) for receiving protrusions 20B, 20C therein. Thus, when size cap 16 is coupled to suspension hook 12, protrusions 20B, 20C operatively engage notches 34B, 34C so that size cap 16 is securely engaged with suspension hook 12.

The use of at least two protrusions 20B, 20C and at least two notches 34B, 34C mitigates against the inadvertent separation of size cap 16 from suspension hook 12 which could result in the loss of size cap 16 and/or the presentment of a safety hazard to children.

Figure 11:
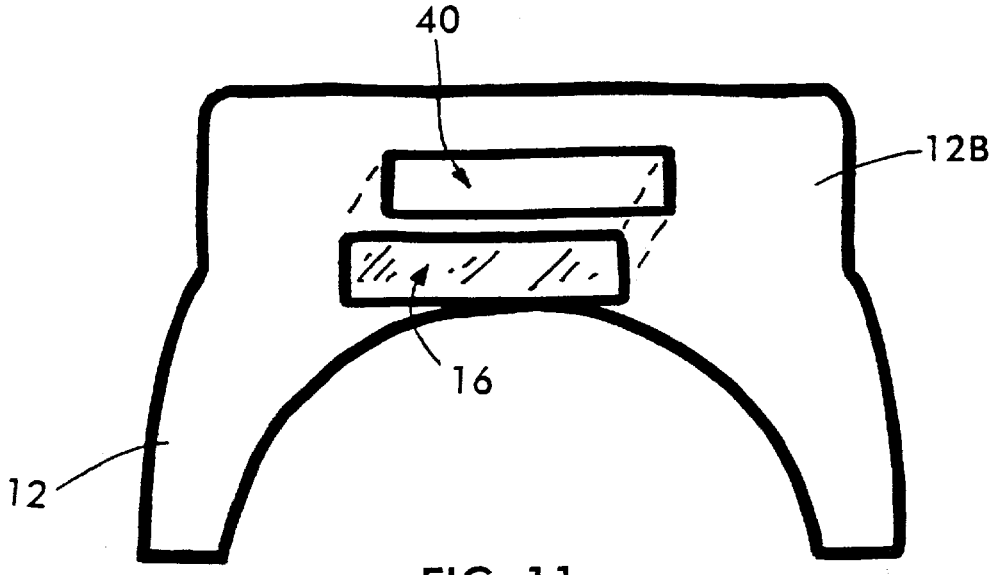
FIG. 11 is a side view of another embodiment of a garment hanger in accordance with the present invention.

Reference is now made to FIG. 11 which shows a suspension hook 12 in accordance with another alternative embodiment of the present invention. The suspension hook 12 includes an upper portion 12B having a recess 40 for receiving size cap 16. Size cap 16 may be securely received within recess 40 using any of the known techniques, such as detents, protrusions, notches, flanges, and the like. Recess 40 may extend partially into upper portion 12B or may extend through upper portion 12B if desired. As would be apparent to one skilled in the art from the above teaching, upper portion 12B of suspension hook 12 and the size cap 16 may be of any desired shape without departing from the scope of the invention.

Figure 12:
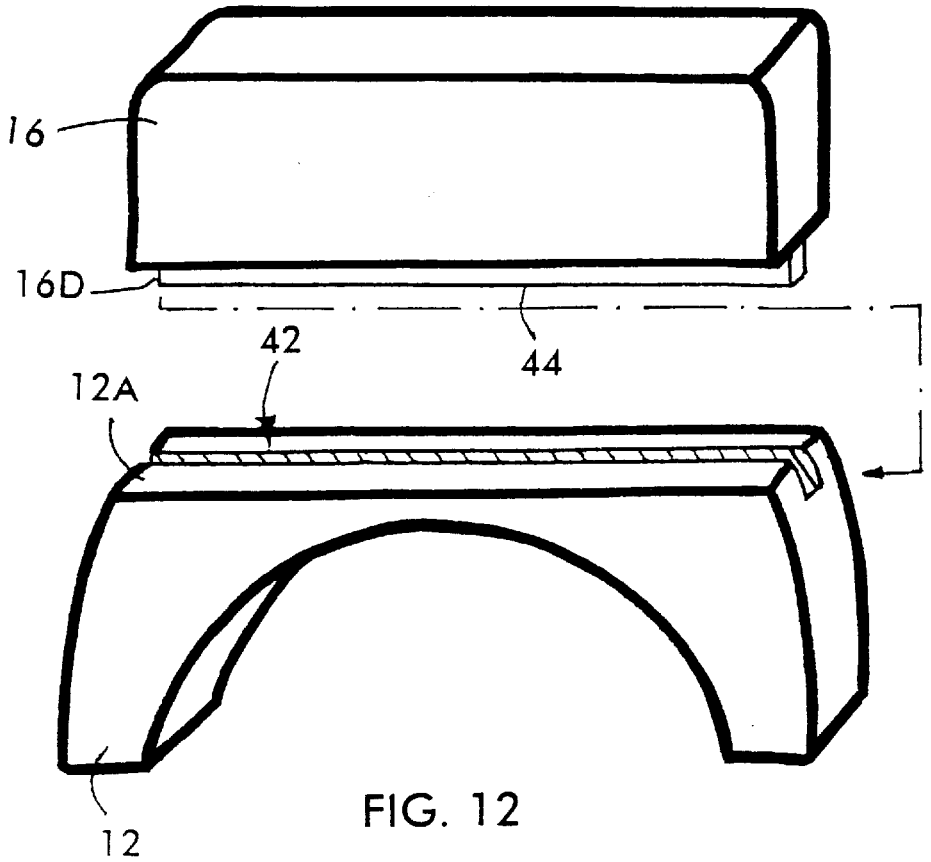
FIG. 12 is a front perspective view of yet another embodiment of a garment hanger in accordance with the present invention.

Reference is now made to FIG. 12 which shows yet another alternative embodiment of the present invention. Suspension hook 12 includes a longitudinal channel 42 extending at least partially along a length of upper portion 12A of suspension hook 12. Size cap 16 includes a longitudinal flange 44 along at least a portion of a length of bottom edge 16D. Longitudinal channel 42 and longitudinal flange 44 are sized and shaped such that longitudinal flange 44 is releasably received within longitudinal channel 42. As is apparent to those skilled in the art from the above teaching, longitudinal flange 44 and longitudinal channel 42 may be adapted using any of the known techniques to securely couple size cap 16 to suspension hook 12.

Although the present invention has been described in relation to particular embodiments thereof, many other variations and modifications and other uses will become apparent to those skilled in the art.

What is claimed is:

1. A hanger, comprising:

an indicator having at least one surface for displaying indicia; and a suspension hook adapted to engage a hook support and having an upper portion including:

a base having opposing lateral edges and opposing axial edges;

first and second tab portions located at respective lateral edges of the base, each of the first and second tab portions including first and second engaging surfaces, respectively, facing a rear one of the axial edges of the base;

a support located between the lateral edges of the base and including a third engaging surface facing a front one of the axial edges of the base; and a recess formed by the first and second engaging surfaces of the first and second tab portions and the third engaging surface of the support, the recess being adapted to releasably receive at least a portion of the indicator to couple the indicator to the suspension hook.

2. The hanger of claim 1, wherein the indicator includes front, rear, side, top and bottom portions, the front portion including the surface for displaying indicia.

3. The hanger of claim 1, wherein the first and second engaging surfaces of the first and second tab portions lie along a front plane and the third engaging surface of the support lies along a rear plane, the front and rear planes being axially displaced to form the recess.

4. The hanger of claim 3, wherein the support extends between the lateral edges of the upper portion of the suspension hook and terminates at lateral ends, the first and second engaging surfaces of the tab portions being laterally spaced away from the respective lateral ends of the support.

5. The hanger of claim 1, wherein the first and second engaging surfaces of the tab portions operatively engage at least part of the front portion of the indicator and the third engaging surface of the support operatively engages at least part of the rear portion of the indicator.

6. The hanger of claim 5, wherein the indicator is substantially plate-shaped having front and rear surfaces and top, bottom and side edges, the side edges and tab portions being adapted such that the indicator is releasably engageable with the suspension hook.

7. The hanger of claim 6, wherein at least one of the respective tab portions of the suspension hook and side edges of the indicator includes a protrusion and at least one of the other respective tab portions and side edges includes an insert adapted to receive the protrusion such that the indicator is snap-fittable in the recess.

8. The hanger of claim 7, wherein the indicator includes a protrusion on each side edge and each tab portion includes an insert for receiving the respective protrusion.

9. The hanger of claim 8, wherein the suspension hook has a tip portion and a neck portion, the inserts of the tab portions being adapted to release the protrusions of the indicator when an external force is applied to the suspension hook which tends to move the tip portion towards the neck portion of the suspension hook.

10. The hanger of claim 1, wherein the indicator includes first and second surfaces for displaying indicia, the support being sized and shaped to cover at least a portion of the indicia on the first surface when the indicator is received in the recess in a first orientation.

11. The hanger of claim 10, wherein the support covers at least a portion of the indicia on the second surface when the indicator is received in the recess in a second orientation.

12. The hanger of claim 1, wherein the recess is extended substantially between the lateral edges of the base.

13. The hanger of claim 12, wherein the indicator has a periphery and a bottom portion of the periphery is releasably received within the recess.

14. A hanger, comprising:

a substantially plate-shaped indicator having front, rear, side, top and bottom portions, at least one of the front and rear portions including a surface for displaying indicia and each side edge of the indicator including at least one protrusion; and a suspension hook adapted to engage a hook support, the suspension hook including:

an upper portion defined by a base having opposing lateral edges and opposing axial edges;

first and second tab portions located at respective lateral edges of the upper portion, the first and second tab portions including first and second engaging surfaces, respectively, facing a rear one of the axial edges of the upper portion and respective inserts adapted to receive the protrusions; and a support including a third engaging surface facing a front one of the axial edges of the upper portion, the support extending between the lateral edges of the upper portion and terminating at lateral ends, the first and second engaging surfaces of the tab portions being laterally spaced away from the respective lateral ends of the support, wherein the first and second engaging surfaces of the first and second tab portions lie along a front plane and the third engaging surface of the support lies along a rear plane, the front and rear planes being axially displaced to form a recess for receiving at least a portion of the indicator, the protrusions being snap fittable within the inserts to releasably couple the indicator to the suspension hook.

15. A hanger, comprising:

an indicator having at least one surface for displaying indicia;

a suspension hook adapted to engage a hook support, the suspension hook having an upper portion including:

a base having opposing lateral edges defining a length of the base and opposing axial edges;

first and second tab portions disposed upon and extending along the length of the base, the tab portions being spaced apart from, and being substantially coplanar with, one another;

an indicator support extending along the length of the base and spaced from the tab portions; wherein the first and second tab portions and the indicator support define a recess extending substantially the length of the base between the lateral edges of the base, the recess being adapted to receive at least a portion of the indicator to couple the indicator to the suspension hook, the indicator support and tab portions being effective to support the indicator when the indicator is disposed within the recess.

16. The hanger of claim 15, wherein the indicator has a periphery and a bottom portion of the periphery is releasably received within the recess.

17. A hanger, comprising:

an indicator having, at least one surface for displaying indicia; and a suspension hook adapted to engage a hook support, the suspension hook having an upper portion including a base having opposing lateral edges and opposing axial edges, the base defining a recess for receiving at least a portion of the indicator to couple the indicator to the suspension hook;

wherein:

the upper portion of the suspension hook releases the indicator in response to a force applied to the suspension hook causing the lateral edges of the base to separate;

the indicator has side edges, the suspension hook further includes first and second tab portions located at respective lateral edges of the base, at least one of the respective tab portions of the suspension hook and side edges of the indicator includes a protrusion, and at least one of the other respective tab portions and side edges includes an insert adapted to receive the protrusion such that the indicator is snap-fittable in the recess;

the indicator includes a protrusion on each side edge and each tab portion includes an insert for receiving a respective protrusion; and the suspension hook has a tip portion and a neck portion, the inserts of the tab portions being adapted to release the protrusions of the indicator when the force is applied to the suspension hook which tends to move the tip portion towards the neck portion of the suspension hook.

18. A hanger, comprising:

an indicator having a first and second surfaces for displaying indicia; and a suspension hook adapted to engage a hook support, the suspension hook having an upper portion including an indicator support defining a recess, the recess being effective to receive at least a portion of the indicator to couple the indicator to the suspension hook;

the indicator support being sized and shaped to cover at least a portion of the indicia on the first surface of the indicator when the indicator is received in the recess in a first orientation.

19. The hanger of claim 18, wherein the indicator support covers at least a portion of the indicia on the second surface when the indicator is received in the recess in a second orientation.

20. A hanger, comprising:

an indicator having at least one surface for displaying indicia and side edges; and a suspension hook adapted to engage a hook support, the suspension hook having an upper portion including:

a base having opposing lateral edges and opposing axial edges;

first and second tab portions disposed upon the base, at least one of the tab portions and side edges of the indicator includes a protrusion and the other of the tab portions and side edges of the indicator includes an insert adapted to receive the protrusion such that the indicator is snap-fittable in the recess; and all indicator support spaced from the tab portions; the first and second tab portions and the indicator support defining a recess therein that is adapted to receive at least a portion of the indicator to couple the indicator to the suspension hook.

21. The hanger of claim 20, wherein the indicator includes a protrusion on each side edge and each tab portion includes an insert for receiving a respective protrusion.

* * * * *